United States Patent [19]

Fletcher

[11] Patent Number: 4,870,405

[45] Date of Patent: Sep. 26, 1989

[54] OBJECT MONITORING AND ALARM DEVICE

[76] Inventor: Robert Fletcher, 5001 Roslyn Rd., Annandale, Va. 22003

[21] Appl. No.: 145,998

[22] Filed: Jan. 20, 1988

[51] Int. Cl.[4] ..... G08B 13/14

[52] U.S. Cl. ..... 340/568; 340/530

[58] Field of Search ..... 340/568, 571, 572, 573, 340/506, 570, 517, 526, 530, 593, 529, 588

[56] References Cited

U.S. PATENT DOCUMENTS

| | | | |
|---|---|---|---|
| 3,959,789 | 5/1976 | McGahee | 340/529 |
| 4,327,360 | 4/1982 | Brown | 340/571 |
| 4,489,314 | 12/1984 | Miller | 340/568 |
| 4,652,865 | 3/1987 | Maharshak | 340/568 |
| 4,794,378 | 12/1988 | Chen et al. | 340/571 |

*Primary Examiner*—Joseph A. Orsino
*Assistant Examiner*—Thomas A. Mullen, Jr.
*Attorney, Agent, or Firm*—Diller, Ramik & Wight

[57] ABSTRACT

An object that is ordinarily held within a receptacle, such as a pen, is monitored to sense removal of the object from the receptacle. Removal of the object initiates a timing cycle. At the conclusion of the timing cycle, an alarm sounds unless the object has been replaced. A reset switch can be provided to reinitiate the timing cycle at any time. If desired, a plurality of object can be monitored, such that removal of any one object begins the timing cycle that leads to the alarm, and termination of the alarm or timing cycle requires replacement of all of the objects.

12 Claims, 1 Drawing Sheet

OBJECT MONITORING AND ALARM DEVICE

BACKGROUND OF THE INVENTION

This invention relates generally to proximity sensing devices, and in particular to article location monitoring and alarm devices.

Various sensor and/or alarm devices are known in the art, and address a variety of environments and monitored events. For example, U.S. Pat. No. 3,298,012 issued to Weller discloses a ladder warning device that provides a warning when an unauthorized person attempts to climb a monitored ladder. The monitored ladder includes one or more cross members that can not be avoided by one who seeks to climb the ladder. A mercury switch associated with this cross member provides an indication that someone has manipulated the cross member and is, hence, seeking to climb the ladder. A visual or audio alarm is then provided. Even if the mercury switch is only opened temporarily, the alarm will continue to ring until either another switch is operated, or until a timing unit expires.

In U.S. Pat. No. 3,710,371 a portable security alarm and alarm system is disclosed that also makes use of a mercury switch. Once activated, the alarm continues to sound until disabled by a predetermined process, such as use of a key lock switch. The device is intended for placement upon or near an object to be monitored. Displacement of the object causes switching of the mercury switch and the sounding of the alarm.

U.S. Pat. No. 3,797,006 discloses another safety alarm system and switch that can be used with a cabinet to monitor access to the cabinet. The device includes a spring biased switch that moves to a closed position as the cabinet is opened, due to the action of the spring. In the closed position a capacitor is allowed to charge up, and if it succeeds in charging up, an audio alarm is sounded. If, however, the cabinet is closed prior to the sounding of the alarm, the capacitor will discharge and the alarm will not sound. The switch can also be moved to a third non-spring biased open position, to allow an authorized user to open the cabinet and leave it open without causing the alarm to sound.

U.S. Pat. No. 4,117,465 discloses an alarm system for vending machines. Specially placed switches monitor the closed or open status of a door associated with the machine, and cause an alarm to sound if the door is opened in an appropriate manner. If an authorized person opens the door in the proper way, by unlocking a latch associated therewith, the unlocking procedure causes the alarm mechanism to be disabled.

U.S. Pat. No. 4,117,468 discloses a sound alarm for protecting briefcases and the like. This device monitors for an unauthorized person either picking the briefcase up, or sliding it along a floor or other surface. An alarm can also be provided if the briefcase is opened without authorization.

U.S. Pat. No. 4,146,886 discloses a freezer alarm that sounds an alarm whenever the temperature within a monitored container, such as a freezer, fails to remain within predetermined limits. To save battery life, the alarm only sounds intermittently during a condition.

U.S. Pat. No. 3,932,859 discloses a warning device such as a smoke detector. This device provides means for sensing the rate of change for the monitored event to avoid false alarms due to slow changes in natural conditions, while remaining fully responsive to rapid changes indicative of the monitored event in question, such as a fire.

U.S. Pat. No. 4,276,545 discloses a door activated burglar alarm that utilizes a time delay to provide for authorized exit from and entrance to the monitored premises.

U.S. Pat. No. 4,630,449 discloses a monitoring apparatus for use in monitoring the temperature in a device like a freezer that undergoes normal operation, such as defrosting, that could be mistaken for a system failure. The device accomplishes this by providing an alarm delay that is at least equal to the normal cycle that would otherwise imitate the undesired event being monitored.

Also, U.S. Pat. Re. No. 28,754 discloses a bed egress alarm circuit that monitors when a person has removed himself from a monitored bed. The device includes an alarm delay to allow for the person to temporarily move himself in the bed without triggering the alarm.

Notwithstanding these and other known devices, there still remain a number of unmet monitor/sense/alarm needs. For example, none of the prior art devices are satisfactory for use with monitoring articles, such as hand-held writing instruments, that are removed from appropriate holding receptacles for intended use by an individual, and that should be returned to the receptacle after utilization. Most of the prior art devices teach that an alarm should immediately be sounded upon occurrence of the monitored event. If one sounds an alarm immediately upon removing the pen from the pen holder, however, one must endure the sound of an alarm during normal and intended use of the pen until it has been returned to the holder. Some of the prior art devices would even require that the alarm continue to sound after the pen has been returned. Neither of these solutions, of course, are acceptable in context. In various ways, the remaining prior art solutions are similarly unsuitable to deal with the situation described.

A need, therefore, exists for a device that will allow monitoring of removal of an object from a holding receptacle, and that will provide an alarm when, and only when, it becomes evident that the object has not been returned to the receptacle within a period of time commensurate with its intended purpose. Such a device should be simple to operate, relatively portable as may be appropriate to certain applications, effective to ensure return of the monitored object to the receptacle, and should accommodate changing needs as they may arise. Further, such a device should be relatively easy to manufacture, and relatively inexpensive to operate.

SUMMARY OF THE INVENTION

These needs and other are substantially met through provision of the object monitoring and alarm device disclosed herein. This device operates in conjunction with an object to be monitored, such as a hand held writing instrument, and a receptacle which receives the object under ordinary conditions. When the object is removed for authorized (or unauthorized) purposes, an object sensor senses removal of the object from the receptacle and causes a timer mechanism to initiate a timing sequence. When a predetermined period of time (such as, for example, two minutes) elapses following removal of the object from the receptacle, the timer mechanism enables a continuous alarm. The alarm, of course, alerts the user of the object and others in the area that the object has not been returned to the receptacle after a normally adequate predetermined period of time.

In one embodiment of the invention, a reset switch can be provided that allows a user to restart the timing sequence without replacing the object itself. This reset option does not avoid the alarm mechanism; it merely restarts the timing cycle. When the predetermined period of time elapses, the alarm will again sound until the object has been replaced.

In other embodiment, a plurality of objects can be monitored. In this embodiment, removal of any one of the objects will initiate the timing cycle. The timing cycle can not be terminated (or the alarm can not be silenced) until all of the objects are in their proper place.

BRIEF DESCRIPTION OF THE DRAWINGS

These and other attributes of the invention will become more clear upon making a thorough review and study of the following description of the best mode for carrying out the invention, particularly when studied in conjunction with the drawings, wherein.

DESCRIPTION OF THE PREFERRED INVENTION

Figure 1:
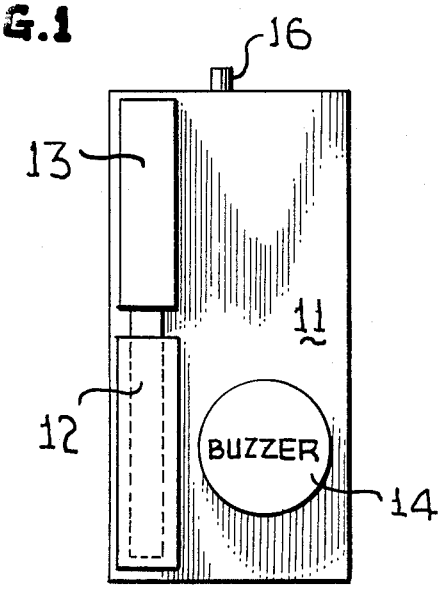
FIG. 1 comprises a front elevational view of the housing for the device, which housing includes the receptacle.
Figure 2:
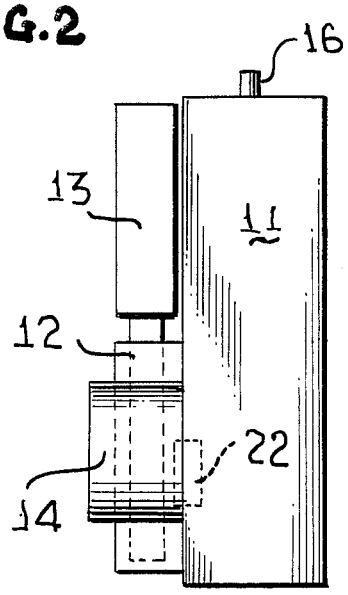
FIG. 2 comprises a side elevational view of the housing.

Referring now to the drawings and in particular to FIGS. 1 and 2, the device can be seen as depicted in conjunction with a housing 11, a receptacle 12, and an object 13 (in this case, a pen) that is disposable within the receptacle. A buzzer 14 has been appropriately mounted to allow an alarm signal to be heard, and a reset switch 16 has also been provided within easy access by a user, as explained hereinafter.

Figure 3:
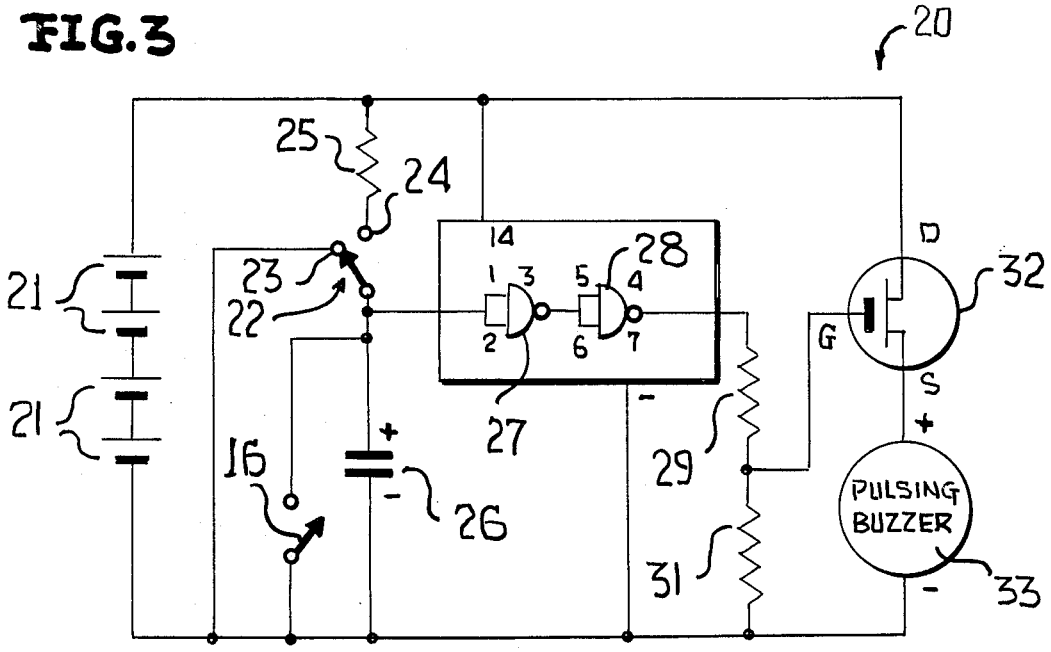
FIG. 3 comprises a schematic representation of the device.

Referring now to FIG. 3, the housing 11 contains electrical circuitry as generally depicted by the numeral 20. The circuit 20 includes a power supply comprised of four 1.5 volt cells (21) that provide a 6 volt DC supply to the remainder of the circuit. A spring biased switch 22 can be provided and positioned so as to be sensitive to the presence or absence of the object 13 with respect to the receptacle 12 (FIG. 2). When in a first position 23 (as when the object 13 is positioned within the receptacle 12), the switch 22 disconnects the power supply from the timer circuit. When in a second position 24 (as when the object 13 is removed from the receptacle 12), the switch 22 functions to charge the timer circuit with the power supply.

When the object 13 has been removed from the receptacle 12, the switch 22 connects the power supply through a 680K resistor 25 to a 220 micro Farad capacitor 26, which then begins to charge and provides the timer circuit function. In the absence of any other action (such as replacing the pen 13 in the receptacle 12), a sufficient voltage will develop across the capacitor 26 and thereby cause a high signal to be output from the two NAND gates 27 and 28 (as provided through use of a 4011 CMOS part). This high output signal in turn energizes by applying approximately supply voltage to a voltage divider comprised of a 220K ohm resistor 29 and a 330K ohm resistor 31 to activate a FET 32 (such as a Radio Shack 276-2074) and thereby activate a buzzer 33 (such as a Radio Shack 273-066).

The buzzer 33 will continue to sound an alarm so long as the capacitor 26 remains sufficiently charged. The status of the latter can be changed in either of two ways. The capacitor 26 can be "permanently" discharged by replacing the object 13 in the receptacle 13 and thereby disconnecting the capacitor 26 from the power supply, or "temporarily" discharged by activating the reset switch (16). The latter course of action will only serve, of course, to begin anew the timing cycle.

Through provision of this invention, a portable, practical means for providing use of a certain article can be made while assuring unattended monitoring of the correct usage of such articles. For example, a bank may wish to make pens available to its patrons for use in preparing checks and other papers that in general require only a moment's use of a writing instrument. If such pens are simply left out and available, they will generally be removed by the users, either with intent or through neglect and carelessness. As an alternative, the pens can be tethered to a general area of use, but such tethers make use of the pen difficult and are not particularly pleasing from an aesthetic standpoint. The present invention allows a pen to be used in an ordinary and customary manner, while simultaneously providing a reminder when necessary to the user to return the pen to the receptacle.

An example of household or office application would be to utilize this device at a telephone to insure availabilty of a writing instrument. In a hospital the device would be used to monitor, for example, a thermometer, pen, pencil or the like.

Those skilled in the art will recognize that a number of modifications could be made with respect to the described embodiments without departing from the spirit of the invention. It should be expressly understood that the scope of the claims are not to be considered as limited to the precise limitations set forth in the absence of specific recitations directed to such limitations.

What is claimed is:

1. An object monitoring and alarm device for use with an object and a receptacle for normally receiving said object, the device comprising:
   (a) object sensing means for sensing when said object is received within said receptacle;
   (b) timer means responsive to said object sensing means for providing a trigger signal following a predetermined period of time following removal of said object from said receptacle;
   (c) alarm means responsive to said timer means for providing an alarm when said object has been removed from said receptacle for too long a period of time; and
   (d) timer reset means for allowing said timer means to be reset regardless of whether said object is received by said receptacle, wherein said timer means is further responsive to said timer reset means to provide said trigger signal following a predetermined period of time following a reset of said timer means.

2. The device of claim 1 wherein said object sensing means comprises a switch that is set to a first position when said object is received by said receptacle and that is set to a second position when said object is not received by said receptacle.

3. The device of claim 2 wherein said timer means comprises a capacitor that is charged when said switch is in said second position and that is instantaneously discharged when said switch is in said first position.

4. The device of claim 1 wherein said device is contained within a housing that includes said receptacle.

5. The device of claim 4 and further including a portable power supply contained within said housing, which power supply provides power to said device.

6. The device of claim 1 wherein said predetermined period of time is approximately two minutes.

7. The device of claim 1 wherein said object comprises a hand-held writing instrument.

8. An object monitoring and alarm device for use with a plurality of objects and at least one receptacle for normally receiving said objects, the device comprising:

(a) object sensing means for sensing when at least one of said objects is removed from said receptacle;

(b) timer means responsive to said object sensing means for providing a trigger signal following a predetermined period of time following removal of any of said objects from said receptacle;

(c) alarm means responsive to said timer means for providing an alarm when at least one of said objects has been removed from said receptacle for too long a period of time; and (d) timer reset means for allowing said timer means to be reset regardless of whether said objects are received by said receptacle, wherein said timer means is further responsive to said timer reset means to provide said trigger signal following a predetermined period of time following a reset of said timer means.

9. The device of claim 8 wherein said device is contained within a housing that includes said receptacle.

10. The device of claim 9 and further including a portable power supply contained within said housing, which power supply provides power to said device.

11. The device of claim 8 wherein said predetermined period of time is approximately two minutes.

12. The device of claim 8 wherein said objects comprise hand-held writing instruments.

* * * * *